United States Patent [19]

Bouron et al.

[11] Patent Number: 4,859,997

[45] Date of Patent: Aug. 22, 1989

[54] DISPLAY SYSTEM FOR DISPLAYING ESSENTIAL DATA BY SEPARATELY HANDLING DIFFERENT PARTS OF THE IMAGE TO MAXIMIZE RELIABILITY

[75] Inventors: Jean P. Bouron, Ville d'Avray; Daniel Giroux, Saint Germain les Corbeil; Pierre Rousseau, Bordeaux, all of France

[73] Assignee: Thomson-CSF, Paris, France

[21] Appl. No.: 132,563

[22] Filed: Dec. 14, 1987

[30] Foreign Application Priority Data

Dec. 16, 1986 [FR] France ..... 8617575

[51] Int. Cl.[4] ..... G09G 3/00

[52] U.S. Cl. ..... 340/752; 340/745; 340/766; 340/783

[58] Field of Search ..... 340/715, 716, 718, 719, 340/745, 752, 766, 721, 780, 781–788, 945, 963, 971; 358/236, 240, 241

[56] References Cited

U.S. PATENT DOCUMENTS 4,468,659 8/1984 Ohba et al. ..... 340/719

FOREIGN PATENT DOCUMENTS 0177247 4/1986 European Pat. Off. .
2571571 11/1986 France .

OTHER PUBLICATIONS

E. D. N. Electrical Design News, vol. 29, No. 15, Jul. 26, 1984, pp. 132–144, Boston, Mass., U.S.; R. Peterson: "High–Capacity, —Contrast LCDs Become Viable CRT Alternatives" *FIG. 1*.

*Primary Examiner*—David K. Moore
*Assistant Examiner*—Jeffrey A. Brier
*Attorney, Agent, or Firm*—Cushman, Darby & Cushman

[57] ABSTRACT

A display system with a matrix type flat panel, for example a liquid crystal panel, has addressing circuits to obtain a television type interlaced image. These circuits are divided into several blocks, both for the addressing of even-numbered and odd-numbered columns and for the addressing of even-numbered and odd-numbered lines, in order to obtain a high-definition image. The graphic processor means used to prepare the video signals to be displayed comprise two sub-groups, one for each of the odd or even image. The two subgroups are respectively associated with two different data measuring devices giving the same essential information, to allow at least one display to be maintained even if one device malfunctions, each of them having at least one symbol generator associated with an image memory to produce a protected display of essential data for use.

8 Claims, 4 Drawing Sheets

DISPLAY SYSTEM FOR DISPLAYING ESSENTIAL DATA BY SEPARATELY HANDLING DIFFERENT PARTS OF THE IMAGE TO MAXIMIZE RELIABILITY

BACKGROUND OF THE INVENTION

1. Field of the Invention

The present invention pertains to systems for displaying data on flat panels of the matrix-addressing type.

The invention applies in particular to the display of control data in avionics. The display may be of the head-up display or head-down display types.

As the older conventional electro-mechanical instruments become obsolete, there is an ever-increasing amount of data to be displayed on the dashboard instruments of modern aircraft. Certain data displayed are essential for flight safety or for operation and should therefore be reliable and always displayed or capable of being displayed.

2. Summary of the Invention

It is an object of the invention to meet these imperative requirements through a particular structure of the display system.

According to the invention, it is proposed to make a display system on a matrix type flat panel comprising a display device consisting of the matrix type panel and matrix addressing means controlled to obtain an image resulting from an "even" image and an "odd" image interlaced with each other, the said means comprising four groups of circuits which respectively address even-numbered lines and even-numbered columns forming the even image and odd-numbered lines and odd-numbered columns forming the odd image, the said system further comprising graphic processor means to prepare the video signals to be displayed by the addressing of columns and scanning signals by line-addressing, the said graphic processor means being divided into two sub-groups, a first sub-group used to prepare the even image and a second sub-group used to prepare the odd image.

The resulting advantages give increased safety through the reduced possibility of displaying wrong data since the proposed structure makes it possible to detect data of this type by observing of the panel. This means that the structure used ensures a high level of safety compatible with very strict requirements as regards the certification of navigability. Another advantage results from the constant availability of essential data as the method used makes it possible to protect these data by reproducing them after a malfunction and thus providing for maintaining a display limited to at least this essential working data. This also means a reduction in maintenance costs because less equipment has to be dismantled.

In the prior art, the French Pat. R-A-2 571 571 describes the making of an image generator which, through an image memory, can control displays using different scannings, either circular scanning produced directly by a symbol generator or other types of scanning using the image store, for example the so-called television type of frame or interlaced scanning or matrix scanning.

BRIEF DESCRIPTION OF THE DRAWINGS

The specific features and advantages of the invention will appear from the following decription given by way of example, and made with reference to the appended figures, of which.

DESCRIPTION OF PREFERRED EMBODIMENTS

Figure 1:
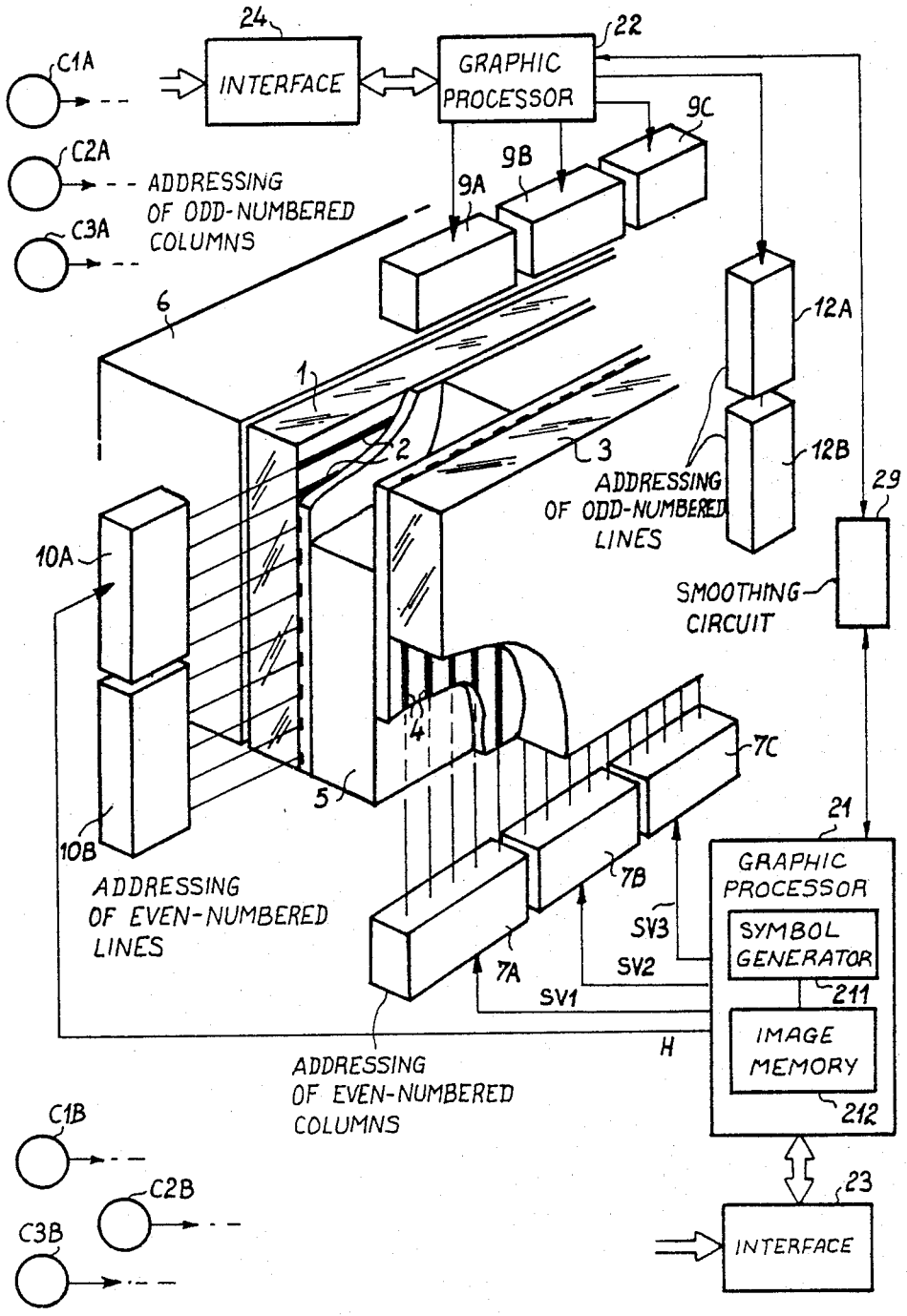
FIG. 1 is a general diagram of a display system according to the invention.

Referring to FIG. 1, we show the structure of the flat panel which is recalled briefly. The said flat panel consists essentially of a back plate 1 made of glass or ceramic, on which transparent electrodes 2, corresponding to the lines of the panel, are set parallel with each other; a front plate 3, also transparent, made of glass or silicon forming the front face of the panel on which another array of electrodes 4 is placed, perpendicular to the first array and corresponding to the columns. Between the two plates, which have little space between them, and in contact with the two arrays of electrodes forming the matrix, there is a solid, liquid or gaseous electro-optic material 5 on which the image is formed. It will be noted that, for color formation, the lines as well as the columns may be distributed to correspond successively to the colors red, green and blue, so as to produce the desired shades or, by simultaneous control, to produce a monochromatic black-and-white image.

The line electrode 4 and the column electrodes 3 are connected to controlling integrated circuits or addressing circuits (called drivers) which send them electrical signals. The panel dots are addressed line by line at a rate such that all dots are reached each time an image is renewed. In general, this rate is 50 Hz to 60 Hz.

Depending on the electro-optical material used, a reaction to the electrical control signals appears at each dot addressed, and the said reaction entails a change in appearance. This change may take two different forms: in terms of either light emission or a change in light-reflecting or light-transmitting capacity. For light-transmission modulating systems, an illuminating device 6 placed behind, produces the luminance needed to view the data displayed on the panel.

Materials corresponding to the first example are used for active devices such as plasma panels, luminescent panels or light-emitting diodes, VFD (vacuum fluorescent display) panels, etc.

Materials corresponding to the second example are used for passive devices. The most known materials are liquid crystals which may be of several types: cholesteric, nematic, smectic, ferro-electric, etc.

These various materials can be classified under two groups. A first group is used in active display devices in which each pixel is in series with a non-linear element of the varistor type (VRD), thin-film transistors (TFTs), back-to-front diodes, etc. The second group comprises materials that have an electro-optic memory effect. These include smectic A liquid crystals working in a combined thermal and electrical mode as well as ferro-electrical smectic liquid crystals.

In the present state of the art, the invention applies more particularly and advantageously to flat liquid-crystal panels with a twisted nematic electro-optical effect. These panels, when associated with an active TFT matrix and with colored filters, give high-definition color matrix type flat panels which are capable, in particular, of displaying all the control data of a modern aircraft.

High-definition liquid crystal display (LCD) panels comprises two sets of circuits to address the even-numbered lines and columns relating to the preparation of a so-called even image, and two other sets to address the off-numbered lines and columns relating to the preparation of a so-called odd image. This operating principle resembles that of television where the image is made up of two interlaced half-frames. However, unlike television systems where the two half-frames are plotted successively in time, the even and odd images are plotted simultaneously, all the pixels being reached each time an image is renewed. These four groups can be seen in FIG. 1. The figure shows the connections at the electrodes of the two groups pertaining to an even image. The connections of the other two groups have not been shown in order to simplify the drawing. To obtain a high-definition image, these four groups have an additional division of circuits. Thus, in the example shown, each column-addressing group is divided into three circuits (namely 7A, 7B, 7C for the even-numbered columns and 9A, 9B, 9C for the odd-numbered columns) and each line-addressing group is divided into two blocks, namely 10A and 10B for the even-numbered lines and 12A and 12B for the odd-numbered lines. The division into two and three groups is given as a non-exhaustive example.

The reasons for this division are related to many factors: the small pitch of the connecting equipment which requires the lines and columns to be interlaced for connection with the addressing circuits, the high cost of the addressing circuits which have a large number of outputs, the fact that the addressing of the pixels is such that, at each line, three columns can be addressed simultaneously, thus reducing the pass-band of the video signal.

An ancillary graphic processor unit prepares the video signals SV1, SV2, SV3 which are respectively applied to the various column-addressing circuits 7 and 9, and a clock signal H which increments the line counters located in the line-addressing circuits 10 and 12.

According to the invention, this ancillary graphic processor unit comprises a first graphic processor 21 which prepares the signals intended for the circuits 7 and 10 which are used to form the even image and a second graphic processor 22 which produces the signals for the circuits 9 and 12 which are used to obtain the odd image. Each of these processors has, as shown for the block 21, at least one symbol-generating circuit 211 associated with an image memory 212. The control signals and those corresponding to the images to be displayed reach the processors 21 and 22 through interface circuits, 23 and 24 respectively. Circuits are indicated by circles: these may be, for example, sensors, the signals of which have to be translated by a specified format. It may be supposed, for example, that the circuit C2A concerns an altitude sensor, the signal of which is applied, after processing, through the interface 24 to the processor 22. Another altitude-measuring device C2B, separate from the previous device, is used to give the same information, through the interface 23, to the processor 21. This redundancy, where there are many different sources to translate the same data to be displayed, is frequently found in airborne or other equipment for safety reasons. In the system proposed, it is used for data classified as essential working data, the display of which has to be preserved.

Figure 2:
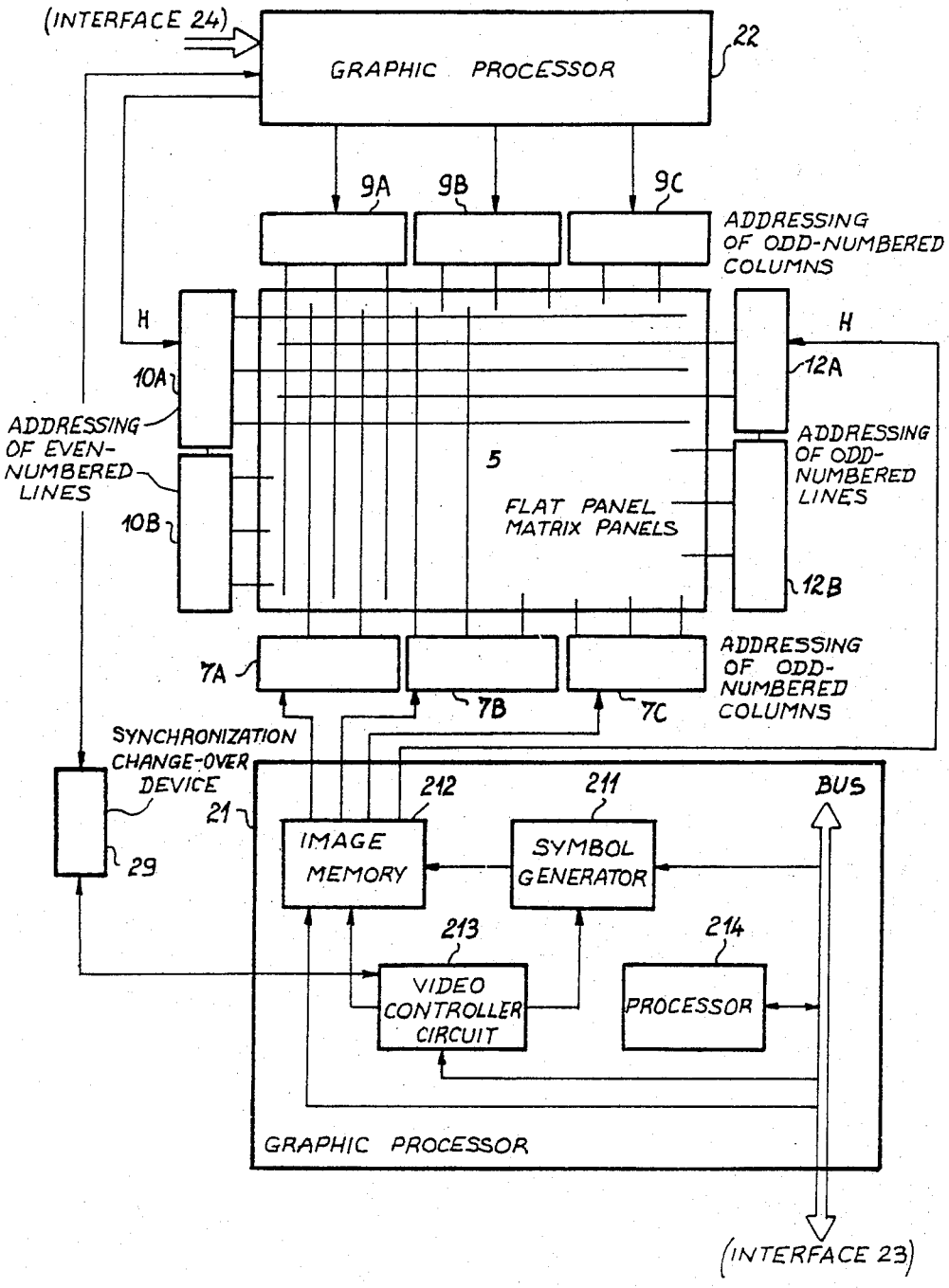
FIG. 2 is a first embodiment of the system.

Each graphic processor comprises, in addition to the symbol generator and the image memory, the essential elements shown in FIG. 2, namely a video controller circuit 213 which controls the accesses from the symbols generator to the image memory and gives the panel-scanning signals to perform a read operation in television mode. The circuit 214 represents a control and computing circuit, such as a microprocessor unit, which receives the data to be displayed on the panel through a bus and the interface 23 (not shown).

Since the two images, namely the even image and the odd image, have to be plotted simultaneously, the subgroups 21 and 22 are coordinated as regards synchronization. One of the video controller circuits, 213 for example, is designated master and gives the synchronizing signals to the other video controller circuit which is designated slave.

The synchronizing signals are a clock signal at the dot rate and the line and image synchronizing signals.

FIG. 2 shows the simplest type of organization envisaged, using the two processors 21 and 22 and making it possible, in the event of a malfunction of a channel, to maintain the display of the image through the other channel with a half definition. The data can thus be permanently available and usable. This method also gives a certain degree of flexibility: the two channels corresponding to the even image and the odd image can be made disymmetrical. Since the data come, as stated earlier, from different data sources, the said difference can also be applied to the symbol generator, the generator 211 at 21 being different from the one used at 22. Thus, in the event of a malfunction or an error in the data displayed, the two interlaced images become different, thus providing visual warning to the user who can no longer rely on the data displayed. This leads the user, namely the pilot in an aircraft, to carry out a verification and checking procedure on other instruments available for the same data so as to eliminate the malfunctioning channel if necessary and reconfigure its display on the remaining channel.

If necessary, the reconfiguration will lead to a change in the master or slave role of the remaining video controller circuit.

This reconfiguration can be done simply by a mechanical change-over device actuated by the operator. The control of this change-over device may also be programmed to respond automatically to various possible situations.

It is possible to use, as symbol generators, processors that specialize in the processing of signals, namely the so-called DSP (Digital Signal Processor). These graphic processors are used to compute the plotting of the symbologies to be stored in the image memories. An example of such a processor is the TMS 320 10 or the TMMS 320 20 by Texas Instruments and ADSP 2100 by Analog Device.

Figure 3:
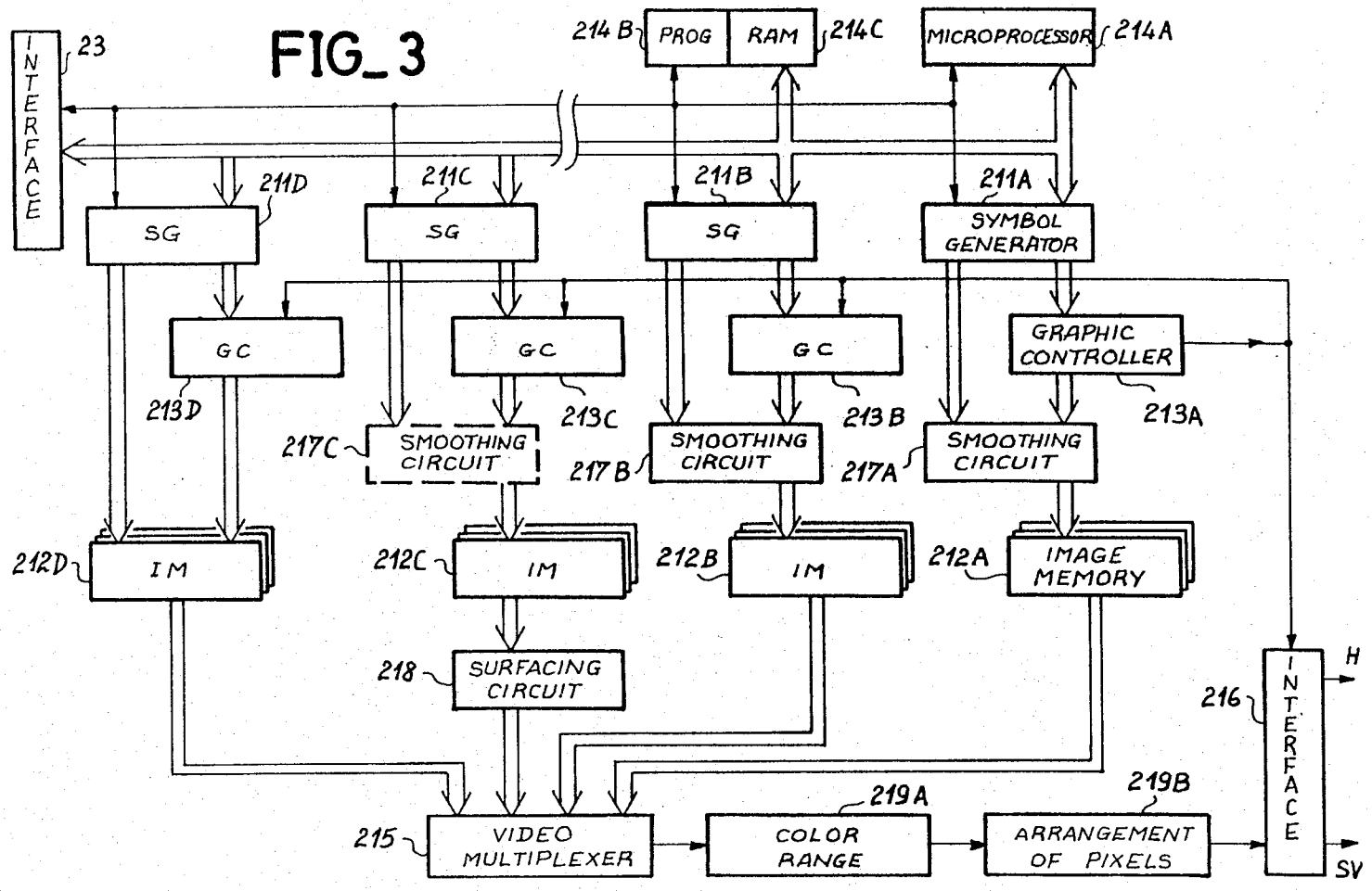
FIG. 3 is a second embodiment of the system.

According to another embodiment shown in FIG. 3, for one of the graphic processors, for example, the processor 22, each processor, instead of having a single symbol generator, has several such generators working in parallel, each of these generators being associated with its image memory. In this example, there are four symbol generators 211A to 211D and their associated circuits, comprising image memories 212A to 212D and graphic controllers 213A to 213D. The processor 214 comprises its main elements, a microprocessor 214A, a program memory 214B and a data memory 214C. The program and data buses are shown. The chain A is the master and lays down the read and write mode synchronizations (pixel, line and frame synchronizations) for the other enslaved chains B, C and D. The video signals given by the image memories are applied to a video multiplexer 215 and then they are sent, through an output interface circuit 216, along with the clock signal, to the even-numbered column addressing circuits and the even-numbered line addressing circuits as shown in the previous figures.

The complementary circuits shown are made according to known techniques and comprise smoothing circuits 217A, 217B, 217C, a surfacing circuit 218, a color range circuit 219A, and a pixel-arranging circuit 219B. For example, it is assumed that the master chain A produces the symbology relating to the static image, the chain B produces the symbology relating to the dynamic image, the chain C produces the surface symbology and the chain D pertains to the symbols coming from a weather radar system. The smoothing circuit 217C is not obligatory.

The functions of these various circuits are recalled below:

The smoothing circuit 217A, B or C gives the traced symbol displayed an analog appearance. In particular it eliminates the steps caused by the fact that the image memory and the panel 5 become discrete. The smoothing is obtained by weighting the level of the video signal of the pixels through which the traced symbol passes as well as that of the adjacent pixels. The smoothing circuit may comprise, for example, a set of read-only memories which, depending on the position and direction of the traced symbol, give the coefficients to be applied to the dots of the traced symbol.

The surfacing circuit 218 makes it possible to fill the interior of the surfaces with a color. The color codes for the dots of each surface are memorized in the image memory.

The color range circuit 219A encodes the video levels R, V, B, using the color codes given by the image memory. The transcoding is obtained by a table which can be loaded dynamically by the processor. This gives an infinity of colors.

Along a scanning line, unlike a display in a mask tube, where the three video signals R, V, B, are sent simultaneously to each dot, only one of the three video signals is sent to each dot of the panel 5. The pixel-arranging circuit 219A, using knowledge of the distribution of color dots on the panel (the said knowledge being stored in a read-only memory for example) to select the right video signal to be sent to the panel 5.

This embodiment using several symbol generators for each image has the following advantages. It shares out the plotting tasks. It has a modular structure making it possible to suit the number of symbol generators to the plotting load for a given display. The display of essential data is kept safe in the event of a malfunction in a chain. Thus if, for example, the essential data are produced by symbol generators of the master chain A and the slave chain B and if the chain B suffers a malfunction, it is possible to have a programming that is planned accordingly, so that the generator 213A of the chain A is made to produce the data lacking in the chain B. In the previous example shown in FIG. 2, each of the processors 21 and 22 had the essential data in a single symbol generator and a malfunction in one of them resulted in a fading of the image displayed. By malfunction we mean a channel malfunction which may start from the image memory onwards and may extend downstream up to the formation of the signal, for example up to the sensor 2A or 2B which have been considered.

For the example envisaged, we may refer to the synthetic video image preparing technique developed in the patent FR-A-2 571 571 already referred to. The said patent defines a cutting up of the stored image into zones by allocating a defined periodic refresh memory, suited to the characteristics of development of the elements in this zone, to each zone. This technique may be applied to the two chains A and B since one pertains to the static elements and the other to the dynamic elements.

Figure 4:
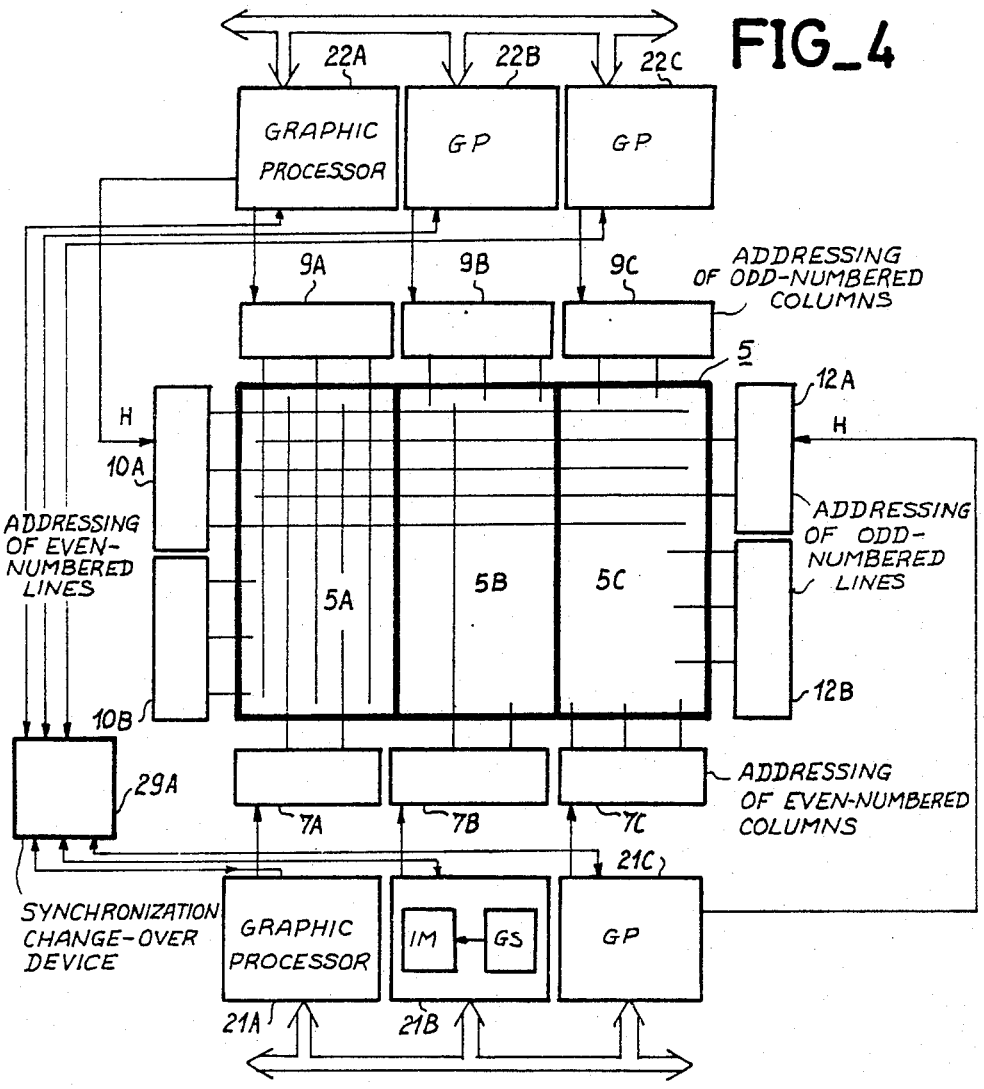
FIG. 4 is a third embodiment of the system.

FIG. 4 shows a third embodiment wherein the display panel 5 is divided into several bands, for example three vertical bands 5A, 5B, 5C. Each band is monitored through the associated column-addressing circuits 9A, 9B, 9C, 7A, 7B and 7C by a pair of graphic processors. These are the graphic processors 21A and 22A for the first band 5A, the graphic processors 21B and 22B for the second band 5B and the graphic processors 21C and 22C for the third band 5C. As indicated in the block 21B, each processor has a symbol generator and an image memory associated with each other. According to this embodiment, the two graphic processors associated with one band plot all the data to be displayed in this band.

The synchronization change-over circuit 29A is derived from the circuit 29 of FIG. 2. It has all the various switches needed to perform the reconfigurations necessary in the event of channel malfunctions, with each malfunction corresponding to a band of the panel and to the associated graphic processors.

In the alternative embodiment shown in FIG. 4, it is not ruled out that there are several symbol generators in each graphic processor, as in the embodiment described with reference to FIG. 3.

The avantages of this third embodiment are that, in the event of a malfunction in one channel, either at the symbol generator or at the columns-addressing circuits or even the panel, or yet again, downstream of the processor, the processing and display of the essential data lost can be taken into account by another channel or by several other channels. Thus, with the remaining elements, it will be possible to present a full image with a reduced format, capable of being used by the pilot.

Figure 5:
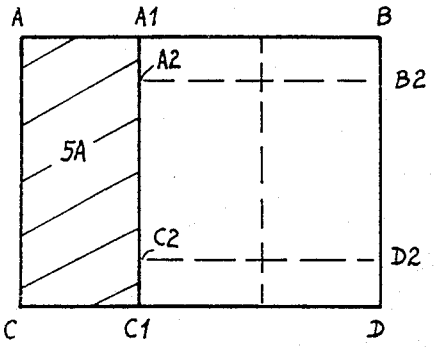
FIG. 5 is a diagram illustrating the protection of the display in the system according to FIG. 4.

FIG. 5 illustrates an example where the channel corresponding to the band 5A goes out of order. The programming is such that the symbology that existed at this surface band A, A1 C C1 is carried to the set which is still demarcated by the surface A1 B C1 D of the panel with a compression in the direction of the lines. The programming can also be planned so as to give the new image the proportions of a similarity transformation by also reducing the height of the image.

Thus, the full image is created in the surface A2 B2 C2 D2, shown with a reduction of a third as compared with the example where the entire panel is on display.

What is claimed is:

1. A display system for data presentation on a matrix type flat panel comprising:

a display device of a matrix type flat panel and having matrix addressing means to obtain an image resulting from even parts of the image and odd parts of the image interlaced with each other, said matrix addressing means comprising four groups of circuits which respectively address even-numbered lines and even-numbered columns forming said even parts of the image and odd-numbered lines and odd-numbered columns forming said odd parts of the image;

graphic processor means for preparing video signals for display by addressing columns and applying scanning signals to the lines, wherein the graphic processor means are divided into two sub-groups, a first sub-group pertaining to preparation of said even parts of the image and a second sub-group pertaining to preparation of said odd parts of the image.

2. A system according to the claim 1 wherein each of the graphic processor means sub-groups comprises at least one symbol generator associated with an image memory.

3. A system according to claim 2 wherein the graphic processor means comprises synchronization means for matrix addressing, said sub-groups being coordinated with one of them acting as master while the other acts as slave.

4. A system according to claim 3 further comprising a change-over means interconnected at synchronizing connections between said sub-groups, for connecting said sub-groups from one of the sub-groups to the other and acting as said master when this role is no longer being performed by said one sub-group because of a malfunction.

5. A system according to the claim 4 wherein each graphic processor sub-group further comprises a control and monitoring processor and a video controller circuit which is connected to said change-over means to give synchronizing signals when it functions as the master or to receive them when it functions as a slave.

6. A system according to the claim 2 wherein each graphic processor sub-group comprises several symbol generators working in parallel, each of them being associated with an image memory in order to store the corresponding data in it, the image memory being connected to a video multiplexer circuit.

7. A system according to the claim 1 applied to a high-definition display, each of the groups of addressing circuits comprising several circuits consisting of: m circuits for the addressing of even-numbered lines, m circuits for the addressing of odd-numbered lines, n circuits for the addressing of even-numbered columns and n circuits for the addressing of odd-numbered columns.

8. A system according to the claim 7 comprising as many graphic processor sub-groups as there are column-addressing circuits so that the panel image can be monitored in the form of n successive bands.

* * * * *